US011680713B2

(12) United States Patent
Kenny

(10) Patent No.: US 11,680,713 B2
(45) Date of Patent: Jun. 20, 2023

(54) EXHAUST CANOPY

(71) Applicant: KENFAM PTY LTD, Dandenong South (AU)

(72) Inventor: Christopher Hilmer Kenny, Glen Iris (AU)

(73) Assignee: KENFAM PTY LTD, Dandenong South (AU)

( * ) Notice: Subject to any disclaimer, the term of this patent is extended or adjusted under 35 U.S.C. 154(b) by 388 days.

(21) Appl. No.: 15/733,036

(22) PCT Filed: Oct. 22, 2018

(86) PCT No.: PCT/AU2018/051146
§ 371 (c)(1),
(2) Date: Apr. 24, 2020

(87) PCT Pub. No.: WO2019/079850
PCT Pub. Date: May 2, 2019

(65) Prior Publication Data

US 2020/0278119 A1 Sep. 3, 2020

(30) Foreign Application Priority Data

Oct. 24, 2017 (AU) ..... 2017904302

(51) Int. Cl.
*F24C 15/20* (2006.01)

(52) U.S. Cl.
CPC ..... *F24C 15/2085* (2013.01); *F24C 15/2035* (2013.01); *F24C 15/2042* (2013.01); *F24C 15/2092* (2013.01); *F24C 15/2021* (2013.01)

(58) Field of Classification Search
CPC .. F24C 15/20; F24C 15/2021; F24C 15/2035; F24C 15/2042; F24C 15/2064;
(Continued)

(56) References Cited

U.S. PATENT DOCUMENTS 3,664,255 A 5/1972 Kuechler
3,890,887 A 6/1975 Kaufman et al.
(Continued)

FOREIGN PATENT DOCUMENTS

CN 101358746 A * 2/2009 ..... F24C 15/2085
CN 104315578 A * 1/2015 ..... F24C 15/2021
(Continued)

OTHER PUBLICATIONS

European Patent Application No. 18871605.4-1009 Extended Search Report dated Jul. 5, 2021, 7 pages.
(Continued)

*Primary Examiner* — Ko-Wei Lin
(74) *Attorney, Agent, or Firm* — Celia H. Leber; Leber IP Law

(57) ABSTRACT

An exhaust canopy comprising: a stationary portion adapted for mounting on a stationary object, above cooking equipment; an exhaust portion for removing or filtering cooking effluent or fluids, the exhaust portion being adjustably connected, directly or indirectly, with the stationary portion or the stationary object; and an adjustment mechanism for moving the exhaust portion with respect to the stationary portion or the stationary object; wherein the exhaust canopy is adjustable between a first configuration in which the exhaust portion is raised, retracted or withdrawn and a second configuration in which the exhaust portion is lowered, protracted, or extended.

5 Claims, 12 Drawing Sheets

(58) Field of Classification Search
CPC ..... F24C 15/2071; F24C 15/2075; F24C 15/2085; F24C 15/2092
USPC ..... 454/63, 65, 67; 126/299 R, 299 D
See application file for complete search history.

(56) References Cited

U.S. PATENT DOCUMENTS

| | | | | |
|---|---|---|---|---|
| 4,085,736 | A | 4/1978 | Kuechler | |
| 6,041,772 | A | 3/2000 | Ward et al. | |
| 7,588,025 | B2 * | 9/2009 | Raus | F24C 15/2014 126/300 |
| 2006/0086352 | A1 | 4/2006 | Bally | |
| 2014/0083412 | A1 * | 3/2014 | Chtchetinin | F24C 15/2092 126/299 D |
| 2016/0091211 | A1 * | 3/2016 | Min | F24C 15/2028 126/299 D |

FOREIGN PATENT DOCUMENTS

| | | | | | |
|---|---|---|---|---|---|
| CN | 104501272 | A | * | 4/2015 | F24C 15/2092 |
| CN | 106439963 | A | * | 2/2017 | F24C 15/2085 |
| CN | 106705158 | A | * | 5/2017 | |
| CN | 106871198 | A | * | 6/2017 | |
| CN | 106885273 | A | * | 6/2017 | F24C 15/20 |
| CN | 106885279 | A | * | 6/2017 | |
| CN | 107062323 | A | * | 8/2017 | |
| CN | 107091488 | A | * | 8/2017 | F24C 15/20 |
| DE | 102016219717 | A1 | * | 4/2018 | F24C 15/2085 |
| EP | 0337935 | A1 | | 10/1989 | |
| EP | 3045822 | A1 | | 7/2016 | |
| JP | 2008002707 | A | * | 1/2008 | F24C 15/2085 |
| KR | 20090001879 | U | * | 2/2019 | |
| WO | WO-2015071898 | A1 | * | 5/2015 | F24C 15/2071 |

OTHER PUBLICATIONS

International Patent Application No. PCT/AU2018/051146 International Search Report and Written Opinion dated Dec. 24, 2018, 11 pages.

* cited by examiner

EXHAUST CANOPY

RELATED APPLICATIONS

This application is a national phase entry of International Patent Application No. PCT/AU2018/051146, filed Oct. 22, 2018, which claims priority from Australian Patent Application No. 2017904302 filed Oct. 24, 2017, the entire disclosures of which are incorporated herein by reference.

FIELD OF THE INVENTION

The present invention relates to an exhaust canopy and in particular, an exhaust canopy suitable for mounting above domestic or commercial cooking equipment.

The invention has been developed primarily for use in methods and systems for extraction of exhaust from a space comprising cooking equipment and will be described hereinafter with reference to this application. However, it will be appreciated that the invention is not limited to this particular field of use.

BACKGROUND OF THE INVENTION

Each document, reference, patent application or patent cited in this text is expressly incorporated herein in their entirety by reference, which means that it should be read and considered by the reader as part of this text. That the document, reference, patent application or patent cited in this text is not repeated in this text is merely for reasons of conciseness.

Any discussion of the background art throughout the specification should in no way be considered as an admission that such background art is prior art, nor that such background art is widely known or forms part of the common general knowledge in the field in Australia or worldwide.

Commercial kitchen exhaust canopies are commonly installed above cooking equipment in order to capture heat, smoke and grease emitted during the cooking process. Typically, the exhaust canopy includes an exhaust plenum with exhaust filters for capturing the emitted grease. The resultant grease build-up in the exhaust plenum and exhaust filters necessitates cleaning of the filters and inside of the plenum on a regular basis, for instance weekly. For traditional canopies installed at around 2000 to 2100 mm above the floor, it is often necessary for cleaning staff to climb up a ladder in order to access the exhaust plenum and remove the grease filters for cleaning. Alternatively, the cleaning staff may need to stand on greasy and potentially hot cooking equipment in order to reach in and remove the filters, and clean the inside of the plenum. As is plainly evident, each of these cleaning options presents a major occupational health and safety risk.

Thus, it may be advantageous to provide a new apparatus which reduces, limits, overcomes, or ameliorates some of the problems, drawbacks, or disadvantages associated with prior art devices, or provides an effective alternative to such devices.

SUMMARY OF THE INVENTION

It is an object of the present invention to overcome or ameliorate at least one or more of the disadvantages of the prior art, or to provide a useful alternative.

Throughout this specification, unless the context requires otherwise, the words "comprise", "comprises" and "comprising" will be understood to imply the inclusion of a stated step or element or group of steps or elements but not the exclusion of any other step or element or group of steps or elements.

Any one of the terms: "including" or "which includes" or "that includes" as used herein is also an open term that also means including at least the elements/features that follow the term, but not excluding others. Thus, "including" is synonymous with and means "comprising".

In the claims, as well as in the summary above and the description below, all transitional phrases such as "comprising," "including," "carrying," "having," "containing," "involving," "holding," "composed of," and the like are to be understood to be open-ended, i.e., to mean "including but not limited to". Only the transitional phrases "consisting of" and "consisting essentially of" alone shall be closed or semi-closed transitional phrases, respectively. The phrase "and/or", as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of" will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one", in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

For the purpose of this specification, where method steps are described in sequence, the sequence does not necessarily mean that the steps are to be carried out in chronological order in that sequence, unless there is no other logical manner of interpreting the sequence.

In addition, where features or aspects of the invention are described in terms of Markush groups, those skilled in the art will recognise that the invention is also thereby described in terms of any individual member or subgroup of members of the Markush group.

According to a first aspect of the invention, there is provided an exhaust canopy. The exhaust canopy may comprise a stationary portion adapted for mounting on a stationary object, above cooking equipment. The exhaust canopy may further comprise an exhaust portion for removing or filtering cooking effluent or fluids. The exhaust portion may be adjustably connected, directly or indirectly, with the stationary portion or the stationary object. The exhaust canopy may further comprise an adjustment mechanism for moving the exhaust portion with respect to the stationary portion or the stationary object. The exhaust canopy may be adjustable between a first configuration in which the exhaust portion is raised, retracted or withdrawn and a second configuration in which the exhaust portion is lowered, protracted, or extended.

According to a particular arrangement of the first aspect, there is provided an exhaust canopy comprising: a stationary portion adapted for mounting on a stationary object, above cooking equipment; an exhaust portion for removing or filtering cooking effluent or fluids, the exhaust portion being adjustably connected, directly or indirectly, with the stationary portion or the stationary object; and an adjustment mechanism for moving the exhaust portion with respect to the stationary portion or the stationary object; wherein the exhaust canopy is adjustable between a first configuration in which the exhaust portion is raised, retracted or withdrawn and a second configuration in which the exhaust portion is lowered, protracted, or extended.

The exhaust portion may be adapted to be raised, retracted or withdrawn for operation. The exhaust portion may be adapted to be lowered, protracted or extended to facilitate user access thereto, such as for cleaning or maintenance. The cooking fluids may comprise at least one of heated air, steam, air borne grease, odour, and smoke.

According to a second aspect of the invention, there is provided an exhaust canopy. The exhaust canopy may comprise a first portion adapted for fixed mounting on a stationary object. The exhaust canopy may further comprise a second portion disposed in relation to the first portion or the stationary object. The exhaust canopy may further comprise an adjustment mechanism for moving the second portion with respect to the first portion.

According to a particular arrangement of the second aspect, there is provided an exhaust canopy, comprising: a first portion adapted for fixed mounting on a stationary object; a second portion disposed in relation to the first portion or the stationary object; and an adjustment mechanism for moving the second portion with respect to the first portion.

The exhaust canopy may be adjustable between a first configuration in which the second portion is stowed for use and a second configuration in which the second portion is withdrawn for cleaning.

The first portion may comprise a supply plenum and the second portion comprise may comprise an exhaust plenum.

According to a third aspect of the invention, there is provided an exhaust canopy suitable for mounting above a cooker, stove top, or cooking equipment. The exhaust canopy may comprise a supply plenum comprising one or more apertures or conduits for passage of supply air. The supply plenum may be adapted for fixed mounting on a wall. The exhaust canopy may further comprise an exhaust plenum connected by interconnecting arms to the supply plenum. The exhaust plenum may comprise one or more apertures or conduits for passage of exhaust. The exhaust plenum may further comprising a filter retainer and removable replaceable filters placed in the filter retainer. The exhaust canopy may further comprise an adjustment mechanism for moving the exhaust plenum with respect to the supply plenum. The adjustment mechanism may comprise interconnecting arms and an electric linear actuator connected with one or more of the interconnecting arms. The actuator may be adapted to cause movement of one or more interconnecting arms, thereby causing movement of the exhaust plenum with respect to the supply plenum. The exhaust canopy may further comprise a control unit mounted on the supply plenum. The control unit may allow a user to control automatic movement of the exhaust plenum via the adjustment mechanism. The exhaust canopy may be adjustable between a cleaning configuration in which the exhaust plenum is lowered towards the cooker, stove top or cooking equipment to facilitate user access to the exhaust filter, and a use configuration in which the exhaust plenum is raised towards the supply plenum, in readiness for use when cooking on the cooker, stove top or cooking equipment.

According to a particular arrangement of the third aspect, there is provided an exhaust canopy suitable for mounting above a cooker, stove top, or cooking equipment comprising: a supply plenum comprising one or more apertures or conduits for passage of supply air, the supply plenum being adapted for fixed mounting on a wall; an exhaust plenum connected by interconnecting arms to the supply plenum, the exhaust plenum comprising one or more apertures or conduits for passage of exhaust, the exhaust plenum comprising a filter retainer and removable replaceable filters placed in the filter retainer; an adjustment mechanism for moving the exhaust plenum with respect to the supply plenum, the adjustment mechanism comprising the interconnecting arms and an electric linear actuator connected with one or more of the interconnecting arms, the actuator being adapted to cause movement of one or more interconnecting arms, thereby causing movement of the exhaust plenum with respect to the supply plenum; a control unit mounted on the supply plenum, the control unit allowing a user to control automatic movement of the exhaust plenum via the adjustment mechanism; wherein the exhaust canopy is adjustable between a cleaning configuration in which the exhaust plenum is lowered towards the cooker, stove top or cooking equipment to facilitate user access to the exhaust filter, and a use configuration in which the exhaust plenum is raised towards the supply plenum, in readiness for use when cooking on the cooker, stove top or cooking equipment.

The exhaust canopy may further comprise a light source mounted on the supply plenum for lighting the cooker, stove top, or cooking equipment beneath.

According to a fourth aspect of the invention, there is provided an exhaust canopy. The exhaust canopy may comprise a supply plenum comprising one or more apertures or conduits for passage of supply air. The supply plenum being adapted for fixed mounting above a cooker. The exhaust canopy may further comprise an exhaust plenum connected by interconnecting arms to the supply plenum. The exhaust plenum comprising one or more apertures or conduits for passage of exhaust, the exhaust plenum comprising a filter retainer. The exhaust canopy may further comprise an adjustment mechanism for moving the exhaust plenum with respect to the supply plenum. The adjustment mechanism may comprise the interconnecting arms and an actuator connected with one or more of the interconnecting arms. The actuator may be adapted to cause movement of one or more interconnecting arms, thereby causing movement of the exhaust plenum with respect to the supply plenum. The exhaust canopy may be adjustable between a cleaning configuration in which the exhaust plenum is lowered towards the cooker or stove top and a use configuration in which the exhaust plenum is raised towards the supply plenum.

According to a particular arrangement of the fourth aspect, there is provided an exhaust canopy comprising: a supply plenum comprising one or more apertures or conduits for passage of supply air, the supply plenum being adapted for fixed mounting above a cooker; an exhaust plenum connected by interconnecting arms to the supply plenum, the exhaust plenum comprising one or more apertures or conduits for passage of exhaust, the exhaust plenum comprising a filter retainer; and an adjustment mechanism for moving the exhaust plenum with respect to the supply plenum, the adjustment mechanism comprising the interconnecting arms and an actuator connected with one or more of the interconnecting arms, the actuator being adapted to cause movement of one or more interconnecting arms, thereby causing movement of the exhaust plenum with respect to the supply plenum; wherein the exhaust canopy is adjustable between a cleaning configuration in which the exhaust plenum is lowered towards the cooker or stove top and a use configuration in which the exhaust plenum is raised towards the supply plenum.

According to a fifth aspect of the present invention, there is provided an exhaust canopy, comprising:

a supply plenum adapted for fixed mounting on a stationary object;

an exhaust plenum disposed in relation to the exhaust plenum; and an adjustment mechanism for moving the exhaust plenum with respect to the supply plenum.

According to a particular arrangement of the fifth aspect, there is provided an exhaust canopy, comprising: a supply plenum adapted for fixed mounting on a stationary object; an exhaust plenum disposed in relation to the exhaust plenum; and an adjustment mechanism for moving the exhaust plenum with respect to the supply plenum.

According to a sixth aspect of the present invention, there is provided an exhaust canopy, comprising:

a first portion adapted for fixed mounting on a stationary object;

a second portion disposed in relation to the first portion or the stationary object; and an adjustment mechanism for moving the second portion with respect to the first portion.

According to a particular arrangement of the sixth aspect, there is provided an exhaust canopy, comprising: a first portion adapted for fixed mounting on a stationary object; a second portion disposed in relation to the first portion or the stationary object; and an adjustment mechanism for moving the second portion with respect to the first portion.

According to a seventh aspect of the present invention, there is provided an exhaust canopy, comprising:

a first portion adapted for fixed mounting on a stationary object, such as a wall and/or ceiling;

a second portion disposed in relation to the first portion; and an adjustment mechanism for moving the second portion with respect to the first portion;

wherein the exhaust canopy is adjustable between a first configuration in which the second portion is stowed for use and a second configuration in which the second portion is withdrawn for cleaning.

According to a particular arrangement of the seventh aspect, there is provided an exhaust canopy, comprising: a first portion adapted for fixed mounting on a stationary object, such as a wall and/or ceiling; a second portion disposed in relation to the first portion; and an adjustment mechanism for moving the second portion with respect to the first portion; wherein the exhaust canopy is adjustable between a first configuration in which the second portion is stowed for use and a second configuration in which the second portion is withdrawn for cleaning.

The exhaust canopy of any one of the preceding aspects may be mounted above cooking equipment. The cooking equipment may comprise a cooker or stove top.

The first portion may comprise a supply portion. The supply portion may comprise a supply plenum. The supply plenum may comprise one or more apertures or conduits for passage of supply air. The one or more apertures or conduits for passage of supply air may comprise one or more supply collars.

The exhaust canopy, first portion, supply portion, or supply plenum of any one of the preceding aspects may comprise a housing for a light source and/or a light source.

The exhaust canopy, first portion, supply portion, or supply plenum of any one of the preceding aspects may comprise a control unit for controlling movement of the second portion by the adjustment mechanism.

The first portion, supply portion, or supply plenum of any one of the preceding aspects may comprise a stationary frame. The first portion, supply portion, or supply plenum of any one of the preceding aspects may further comprise panelling mounted on the stationary frame. The stationary frame, on which the first portion, supply portion, or supply plenum is adapted for mounting, may comprise a wall and/or ceiling.

The exhaust canopy of any one of the preceding aspects may further comprise a first portion adapted for fixed mounting on a stationary object. The exhaust canopy may further comprise a second portion disposed in relation to the first portion or the stationary object. The second portion may comprise an exhaust portion comprising an exhaust plenum. The exhaust plenum may comprise one or more apertures or conduits for passage of exhaust. The one or more apertures or conduits for passage of exhaust may comprise one or more exhaust collars.

The second portion, exhaust portion, or exhaust plenum of any one of the preceding aspects may comprise a retainer for an exhaust filter and/or an exhaust filter wherein the retainer and/or filter may be adapted to be accessible by hand when the second portion, or exhaust portion, or exhaust plenum is moved into a suitable position.

The second portion, exhaust portion, or exhaust plenum of any one of the preceding aspects may comprise a moveable frame. The moveable frame may be moveable with respect to the stationary frame.

The second portion, exhaust portion, or exhaust plenum of any one of the preceding aspects may further comprise panelling mounted on the movable frame. The panelling may comprise an opening adapted for user access to the filter retainer and/or exhaust filter.

The adjustment mechanism of any one of the preceding aspects may comprise an actuator. The actuator may comprise a linear actuator. The linear actuator may comprises an electric actuator. The adjustment mechanism may comprise one or more interconnecting members adapted for interconnecting the first portion and the second portion.

The second portion of any one of the preceding aspects may be disposed in relation to the first portion by the interconnecting members. The one or more members interconnecting the first and second portions may comprise interconnecting arms. The interconnecting arms may comprise pairs of upper and lower arms. The actuator may be configured to cause movement of one or more of the interconnecting members interconnecting the first portion and the second portion, thereby causing movement of the second portion.

The exhaust canopy of any one of the preceding aspects may be adjustable between: a first configuration in which the second portion is more closed with respect to the first portion; and a second configuration in which the second portion is more open with respect to the first portion. The first configuration may comprise a use configuration and the second configuration may comprise a non-use configuration. The non-use configuration may comprise a cleaning configuration.

In the first configuration, the second portion may be raised towards the first portion, whereas in the second configuration, the second portion may be lowered away from the first portion. In the first configuration, the second portion may be raised away from the cooking equipment, and in the second configuration, the second portion may be lowered towards the cooking equipment. In the second configuration, the second portion may be accessible by the hand of a user standing on the ground.

The exhaust canopy of any one of the previous aspects may be configured to extract exhaust air originating from a space comprising cooking equipment when such cooking equipment is in use.

The exhaust canopy of the previous aspects may be adapted to receive and disperse an exhaust comprising exhaust air, wherein the exhaust air may include smoke, odour and/or grease and exhaust air is heated above room temperature. The exhaust canopy of any one of the previous aspects may be configured to extract exhaust air originating from a space comprising cooking equipment when such cooking equipment is in use.

Reference throughout this specification to "one embodiment", "an embodiment", "one arrangement" or "an arrangement" means that a particular feature, structure or characteristic described in connection with the embodiment/arrangement is included in at least one embodiment/arrangement of the present invention. Thus, appearances of the phrases "in one embodiment/arrangement" or "in an embodiment/arrangement" in various places throughout this specification are not necessarily all referring to the same embodiment/arrangement, but may. Furthermore, the particular features, structures or characteristics may be combined in any suitable manner, as would be apparent to one of ordinary skill in the art from this disclosure, in one or more embodiments/arrangements.

Similarly it should be appreciated that in the above description of example embodiments/arrangements of the invention, various features of the invention are sometimes grouped together in a single embodiment/arrangement, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment/arrangement. Thus, the claims following the Detailed Description are hereby expressly incorporated into this Detailed Description, with each claim standing on its own as a separate embodiment/arrangement of this invention.

Furthermore, while some embodiments/arrangements described herein include some but not other features included in other embodiments/arrangements, combinations of features of different embodiments/arrangements are meant to be within the scope of the invention, and form different embodiments/arrangements, as would be understood by those in the art. For example, in the following claims, any of the claimed embodiments/arrangements can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

In describing the preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar technical purpose. Terms such as "forward", "rearward", "radially", "peripherally", "upwardly", "downwardly", and the like are used as words of convenience to provide reference points and are not to be construed as limiting terms.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

BRIEF DESCRIPTION OF THE DRAWINGS

In the drawings like structures are referred to by like numerals throughout the several views. The drawings shown are not necessarily to scale, with emphasis instead generally being placed upon illustrating the principles of the present invention.

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

DESCRIPTION OF EMBODIMENTS

Figure 1:
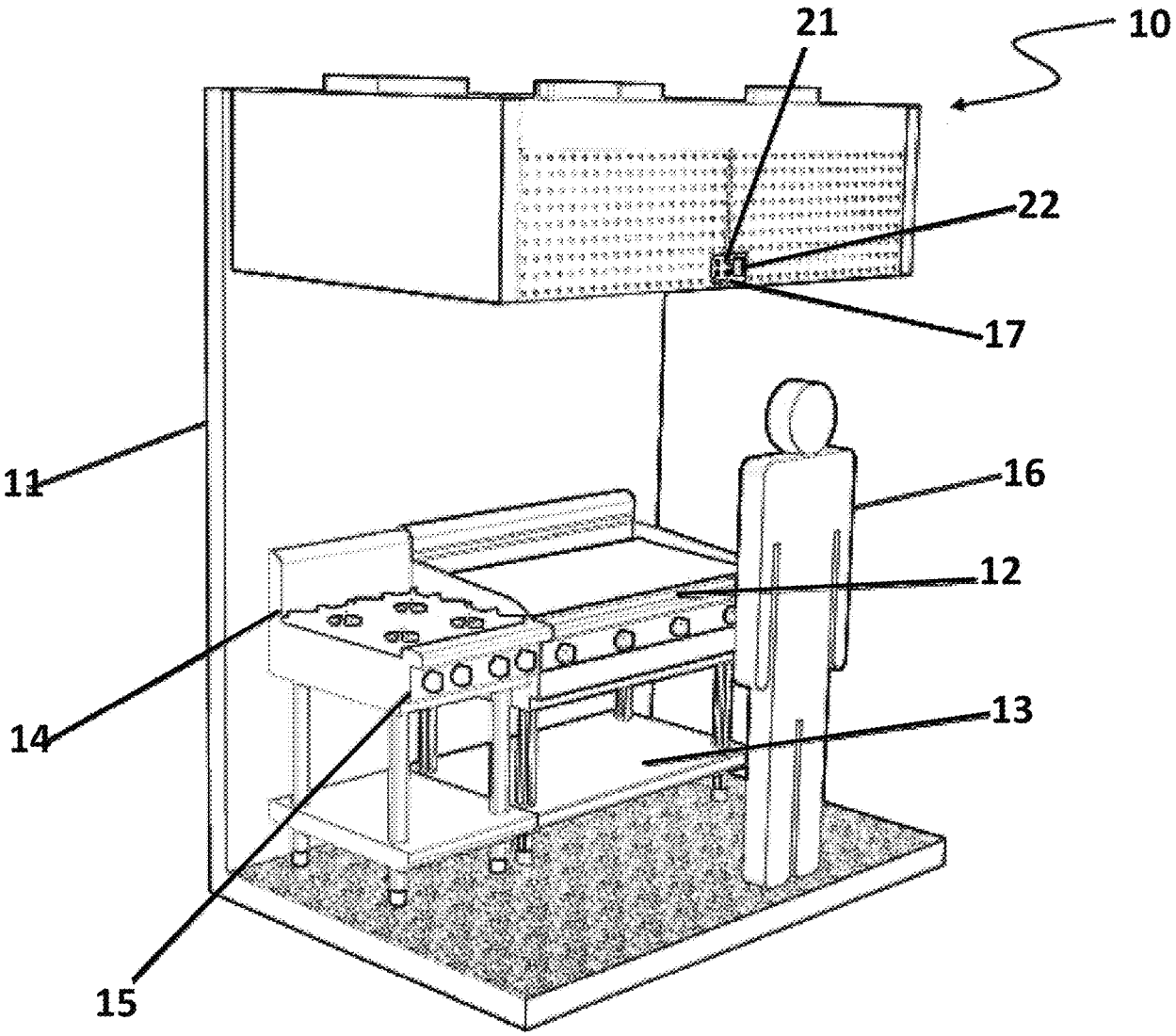
FIG. 1 is a front isometric view of an installed first example exhaust canopy with right side panel removed mounted above cooking equipment in front of which a user is standing, the exhaust canopy being in a use configuration.

Referring to FIG. 1, there is shown an installed exhaust canopy, generally designated 10, in accordance with a first form of the invention. The exhaust canopy is adapted to receive and disperse an exhaust, the exhaust comprising exhaust air, wherein the exhaust air includes smoke, odour and/or grease and the exhaust air is heated above room temperature. The exhaust canopy is configured to extract exhaust air originating from a space comprising cooking equipment when such cooking equipment is in use. The exhaust canopy 10 is mounted at its rear to a vertical wall 11, and overhangs a stove top 12 of a stove cooker 13 and a gas top 14 of a gas cooker 15. At the rear of the exhaust canopy 10 is located a control unit 17 having up and down buttons, 21 and 22 respectively, for configurational adjustment of the canopy 10. A person 16 is shown standing in front of the stove and gas cookers, 13 and 15 respectively. The exhaust canopy 10 is shown in a resting or use configuration, as is required for capturing heat, smoke, odour or grease emitted from foods being cooked on the stove and gas tops, 12 and 14 respectively.

Figure 2:
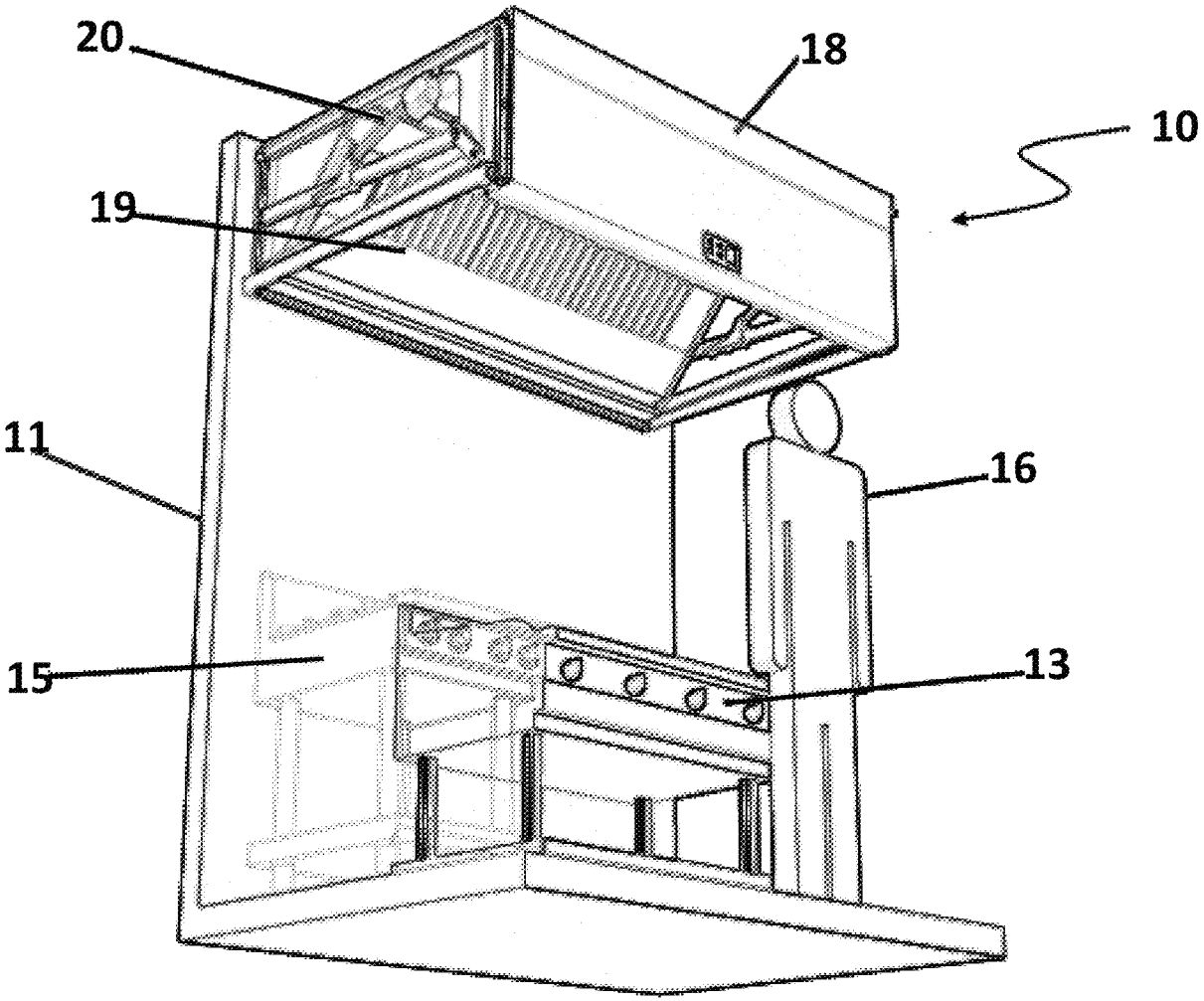
FIG. 2 an isometric view of the installed first example exhaust canopy from below and beneath with left and right side panels removed, and with the canopy in the use configuration.

FIG. 2 also shows the installed exhaust canopy 10 in the use configuration. From this view can be seen parts of the canopy 10 including a fixed or stationary portion 18, an adjustable or mobile exhaust portion/plenum 19, and an adjustment mechanism 20 for continuously adjusting the exhaust plenum 19 between the use configuration and an open or cleaning configuration. As can be seen, the exhaust plenum 19 of the canopy 10 is stowed within the fixed portion 18 when in the use configuration.

Figure 3:
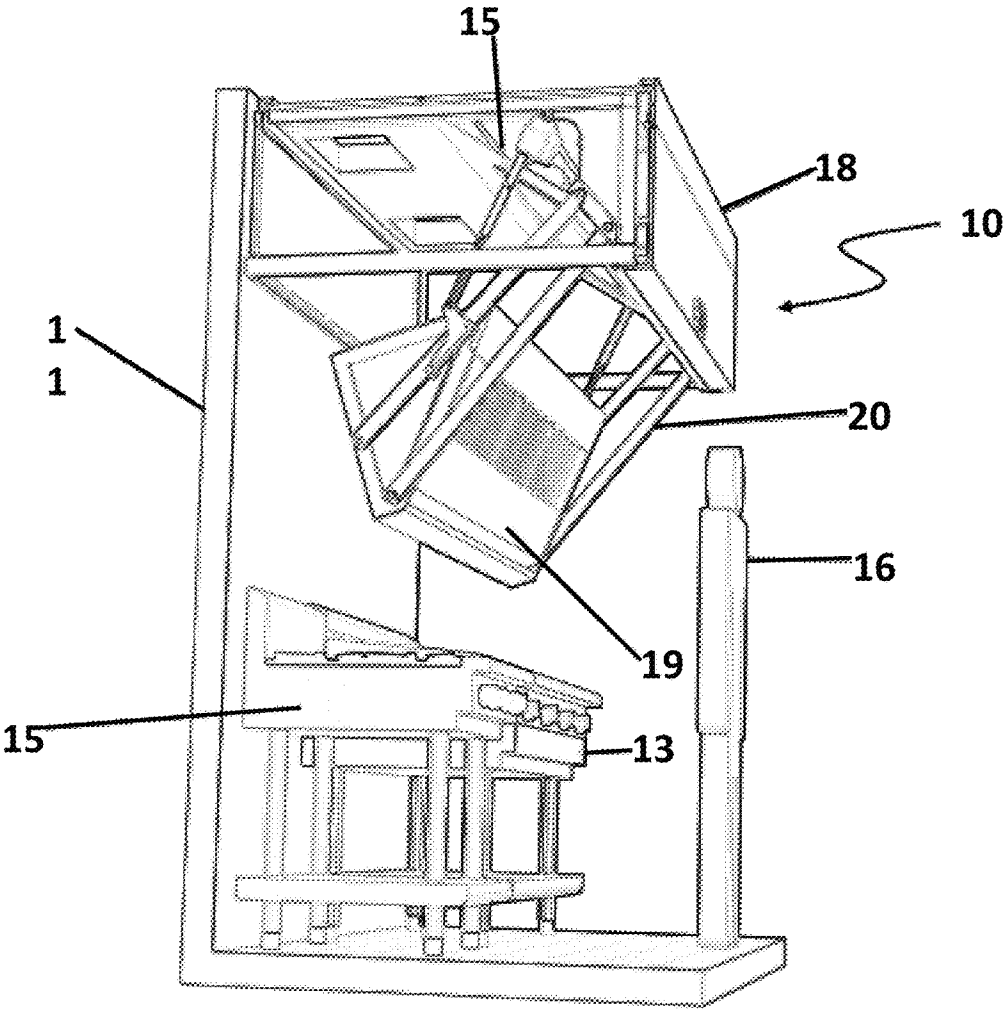
FIG. 3 is a side isometric view of the installed first example exhaust canopy with left and right side panels removed and with an exhaust portion of the canopy partially lowered.
Figure 4:
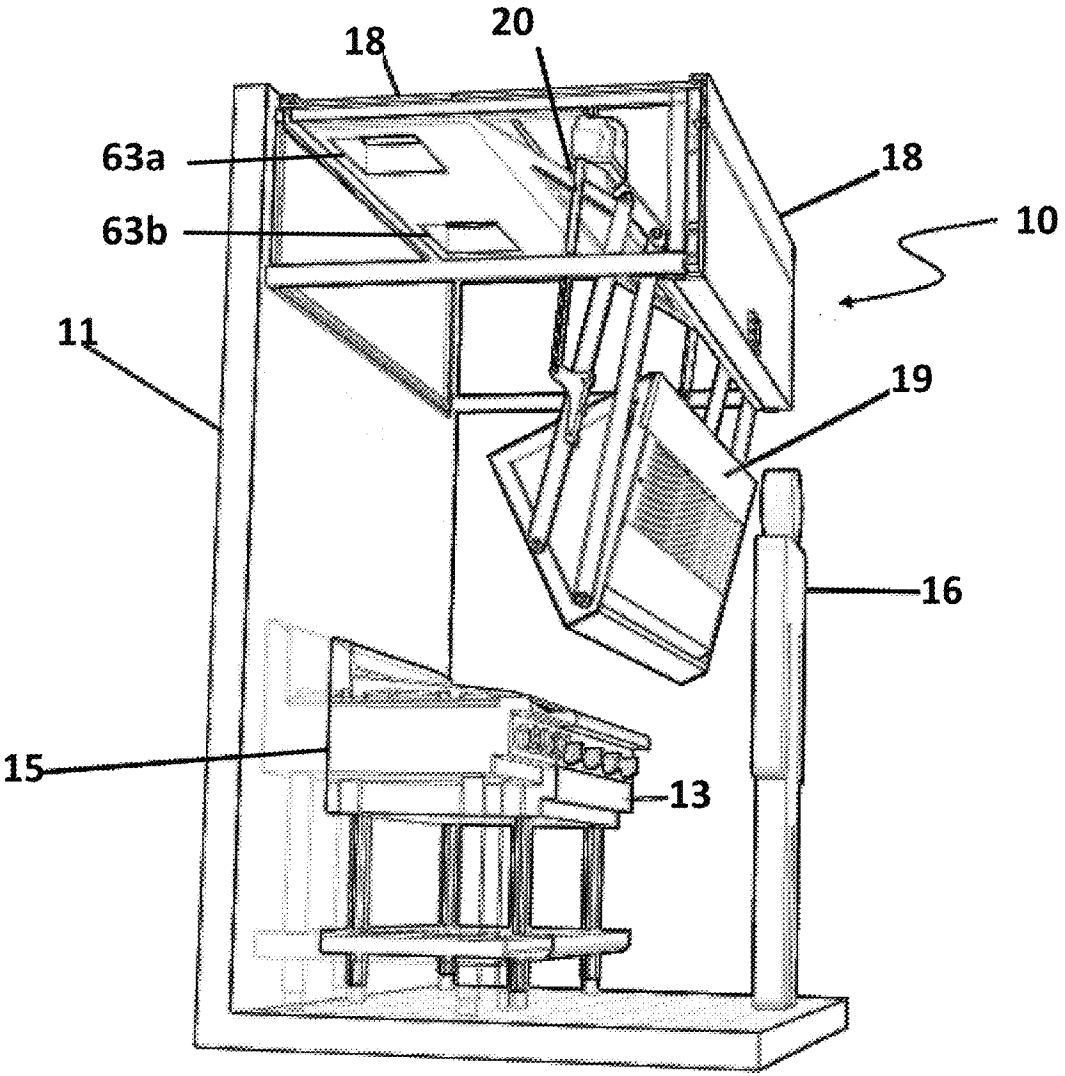
FIG. 4 is a side isometric view of the installed first example exhaust canopy with left and right side panels removed and with the exhaust portion of the canopy fully lowered, bringing the canopy into a cleaning configuration.

On reaching up to the control unit 17 and pressing the down button 22, the person 16 is able to lower the exhaust plenum 19 of the canopy 10 from within the fixed portion 18, as can be seen in FIG. 3, with the canopy shown in an intermediate or partially lowered or open configuration. The exhaust plenum 19 can be further lowered until the canopy 10 reaches the cleaning configuration as shown in FIG. 4. Once the canopy 10 reaches the cleaning configuration, the exhaust plenum 19 is within arm's reach allowing the person 16 to wipe clean its internal aspects, and remove a grease filter housed within for cleaning or replacement.

Figure 5:
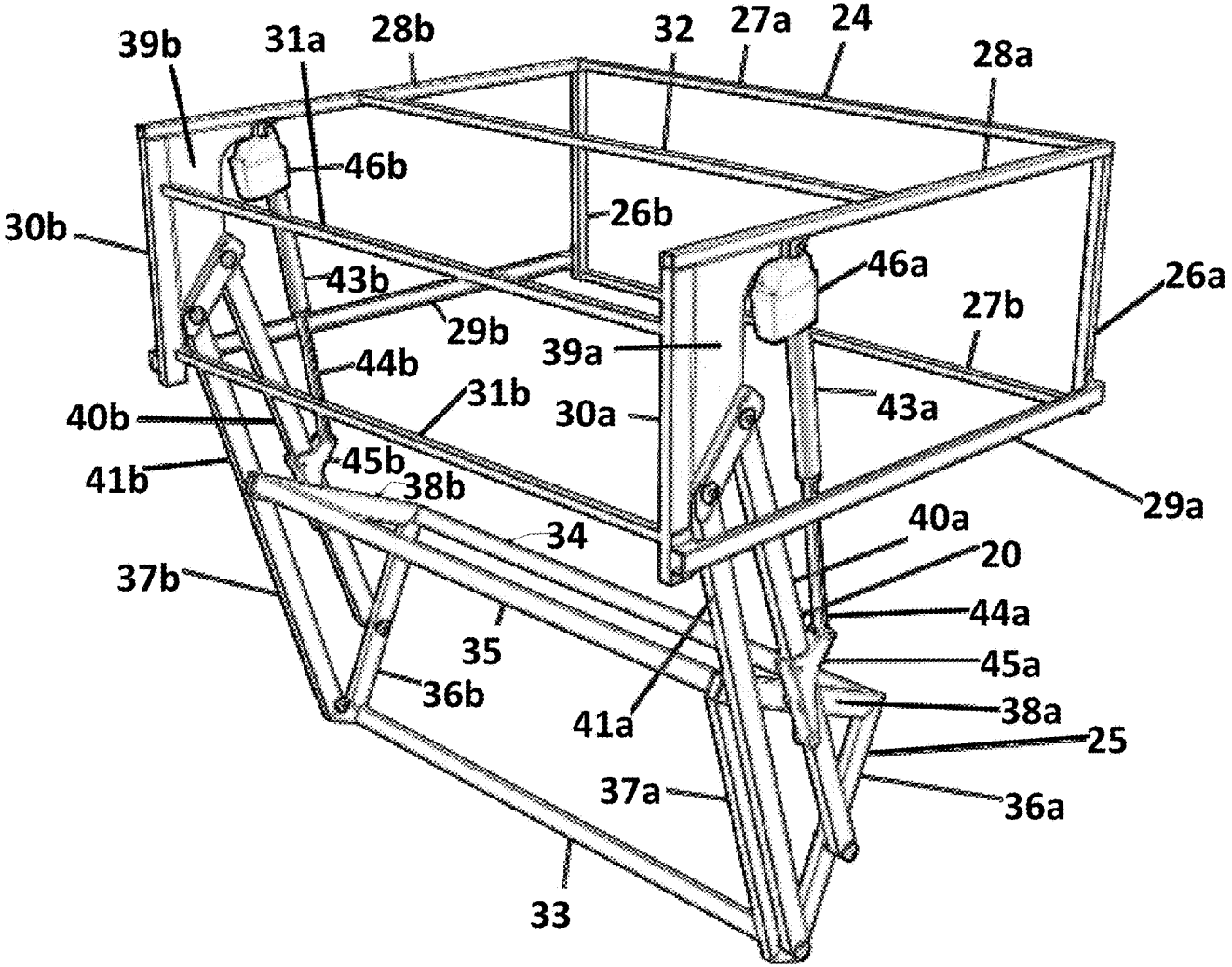
FIG. 5 is a view of a frame of the first example exhaust canopy uninstalled, with the frame in the cleaning configuration.
Figure 6:
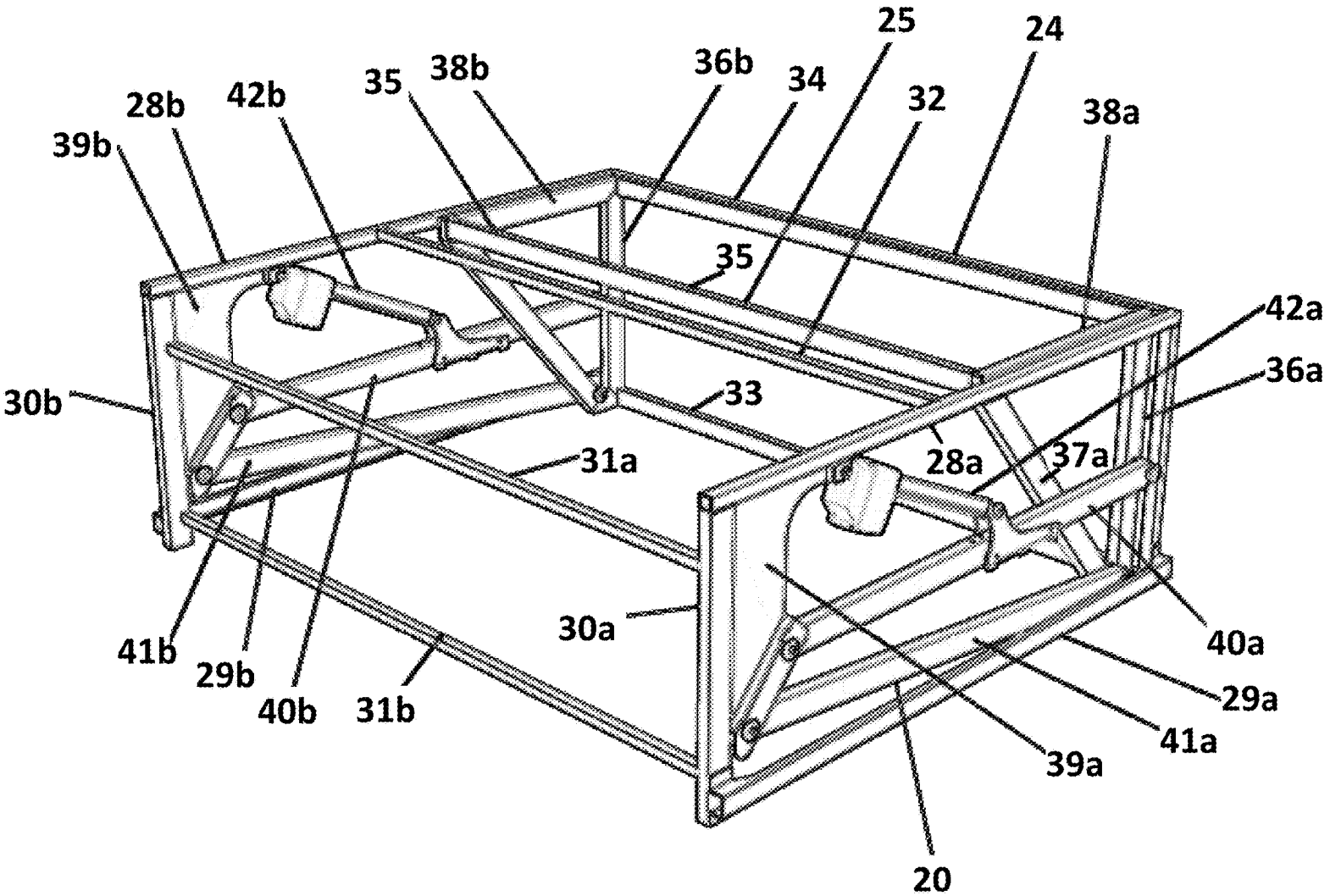
FIG. 6 is a view of the frame of the first example exhaust canopy uninstalled, with the frame in the use configuration.

Referring now to FIGS. 5 and 6, there is shown a frame, generally designated 23, of the exhaust canopy 10. The frame 23 is shown in the open cleaning configuration in FIG. 5 and the closed use configuration in FIG. 6. The frame 23 comprises a fixed section 24 which internally supports and forms part of the fixed portion 18 of the canopy 10. The frame 23 further comprises an exhaust section 25 which internally supports and forms part of the exhaust plenum 19 of the canopy 10. The fixed and exhaust frame sections, 24 and 25 respectively, are interconnected by the adjustment mechanism 20.

More specifically, the fixed section 24 of the frame has left and right vertical rear rods, 26*a* and 26*b* respectively. Connected with and extending between top ends of the vertical rear rods 26*a*/26*b*, is a top horizontal rear rod 27*a*. Similarly, connected with and extending between bottom ends of the vertical rear rods 26*a*/26*b*, is a bottom horizontal rear rod 27*b*.

Connected with and extending forwardly from the top end of left vertical rear rod 26*a*, and the left outer end of top horizontal rear rod 27*a*, is a left top horizontal side rod 28*a*. Similarly, connected with and extending forwardly from the top end of right vertical rear rod 26*b*, and the right outer end of top horizontal rear rod 27*a*, is a right top horizontal side rod 28*b*.

Connected with and extending forwardly from the bottom end of left vertical rear rod 26*a*, and the left outer end of bottom horizontal rear rod 27*b*, is a left bottom horizontal side rod 29*a*. Similarly, connected with and extending forwardly from the bottom end of right vertical rear rod 26*b*, and the right outer end of bottom horizontal rear rod 27*b*, is a right bottom horizontal side rod 29*b*.

Further still, the fixed section 24 of the frame has left and right vertical front rods, 30*a* and 30*b* respectively. Connected with and extending forwardly from the top end of left vertical front rod 30*a* is the left top horizontal side rod 28*a*. Similarly, connected with and extending forwardly from the top end of right vertical front rod 30*b* is the right top horizontal side rod 28*b*.

Connected with and extending forwardly from the bottom end of left vertical front rod 30*a* is the left bottom horizontal side rod 29*a*. Similarly, connected with and extending forwardly from the bottom end of right vertical front rod 30*b* is the right bottom horizontal side rod 29*b*.

Connected with and extending between vertical front rods 30*a*/30*b* towards their top end is a top horizontal front rod 31*a*. Similarly, connected with and extending between bottom vertical front rods 30*a*/30*b* towards their bottom end is a bottom horizontal front rods 31*b*. Connected between left and right top horizontal side rods, 28*a* and 28*b*, about midway along their length, is an intermediate top rod 32.

The exhaust section 25 of the frame 23 has three planar left sided members in the form of a first left rod 36*a*, a second left rod 37*a*, and a third left rod 38*a*. The first and second left rods, 36*a* and 37*a*, are of similar length, whereas the third left rod 38*a* is about two thirds of their lengths. The left sided members are connected end to end to form a left triangular frame section.

Similarly, the exhaust section 25 of the frame 23 has three planar right sided members in the form of a first right rod 36*b*, a second right rod, 37*b* and a third right rod 38*b*. The first and second right rods, 36*b* and 37*b*, are of similar length, whereas the third right rod 38*b* is about two thirds of their lengths. The right sided members are connected end to end to form a right triangular frame section.

Additionally, the exhaust section 25 of the frame 23 has three parallel horizontal members in the form of a first horizontal rod 33, a second horizontal rod 34, and a third horizontal rod 35. The first horizontal rod 33 is connected with and extends between joined ends of the first and second rods, 36*a*/37*a* and 36*b*/37*b*. The second horizontal rod 34 is connected with and extends between joined ends of the first and third rods, 36*a*/38*a* and 36*b*/38*b*. The third horizontal rod 35 is connected with and extends between joined ends of the second and third rods, 37*a*/38*a* and 37*b*/38*b*.

The adjustment mechanism 20 comprises left and right vertical plates, 39*a* and 39*b* respectively. The left vertical plate 39*a* is planar with and attaches above to the left top horizontal side rod 28*a* and behind to the left front vertical rod 30*a*. Similarly, the right vertical plate 39*b* is planar with and attaches above to the right top horizontal side rod 28*b* and behind to the right front vertical rod 30*b*.

The adjustment mechanism 20 further comprises upper left and right adjustment arms, 40*a* and 40*b* respectively, and lower left and right adjustment arms, 41*a* and 41*b* respectively. The upper left adjustment arm 40*a* is pivotally or rotatably attached at one end to the left first rod 36*a* and at its other end to the left vertical plate 39*a*. Similarly, the upper right adjustment arm 40*b* is pivotally or rotatably attached at one end to the right first rod 36*b* and at its other end to the right vertical plate 39*a*. The lower left adjustment arm 41*a* is pivotally or rotatably attached at one end at the junction of the left first rod 36*a* and the left second rod 37*a*, and at its other end to the left vertical plate 39*a*. Similarly, the lower right adjustment arm 41*b* is pivotally or rotatably attached at one end at the junction of the right first rod 36*b* and the right second rod 37*b*, and at its other end to the right vertical plate 39*b*.

Also present as part of the adjustment mechanism 20 are left and right electric linear actuators, 42*a* and 42*b* respectively. Each actuator 42*a*/42*b* comprises a housing unit 46*a*/46*b*, telescopic adjustment means having an outer tubular member 43*a*/43*b* and an inner tubular member 44*a*/44*b*, and an attachment bracket 45*a*/45*b* which is pivotally connected with its respective inner tubular member 44*a*/44*b*. The left linear actuator 42*a* is attached at one end by its bracket 45*a* to the left upper adjustment arm 40*a* and at its other end by connection of a lug extending from its housing unit 46*a* with the left vertical plate 39*a*. Similarly, the right linear actuator 42*b* is attached at one end by its bracket 45*b* to the right upper adjustment arm 40*b* and at its other end by connection of a lug extending from its housing unit 46*b* with the right vertical plate 39*b*.

As is evident in FIGS. 5 and 6, lowering of the cantilevered exhaust section 24 of the frame results from telescopic lengthening by virtue of extension of the inner tubular members 44*a*/44*b* from within respective outer tubular members 43*a*/43*b*. Conversely, raising of the cantilevered exhaust section 24 of the frame results from telescopic shortening by virtue of retraction of the inner tubular members 44*a*/44*b* into their respective outer tubular members 43*a*/43*b*.

Figure 7:
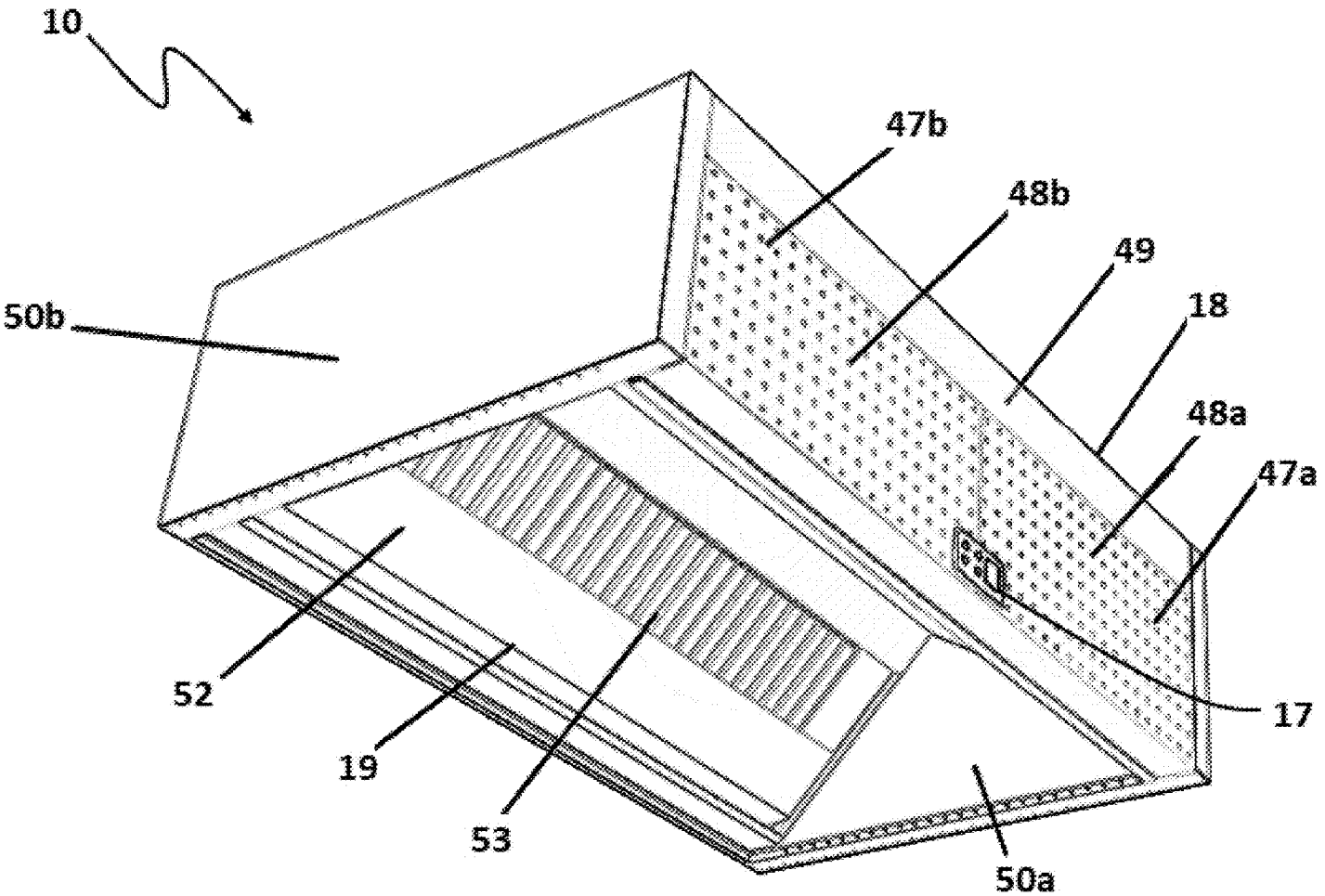
FIG. 7 is an underneath front isometric view of the first example exhaust canopy in the use configuration.

Referring now to FIG. 7, there is shown the exhaust canopy 10 from in front and beneath in its use configuration with the exhaust portion 19 retracted within the confines of the fixed portion 18. The fixed portion 18 comprises various panels mounted on the fixed section 24 of the frame 23. More specifically, the fixed portion 18 comprises left and right front panels, 47*a* and 47*b* respectively, each having its own grilled region, 48*a* and 48*b*. Extending horizontally atop the front panels 48*a*/48*b* is a front top bracket 49. At the rear of the exhaust canopy 10, opposite the front panels 48*a*/48*b*, is a rear panel 51 (see FIG. 9). Additionally, the fixed portion comprises left and right side panels, 50*a* and 50*b*, which extend on opposite sides of the canopy 10 between the front and rear panels. Also visible in FIG. 7, the exhaust portion 19 comprises a front exhaust panel 52 which is mounted on the exhaust section 25 of the frame 23. The front exhaust panel 52 has its own removable grease filters 53.

Figure 8:
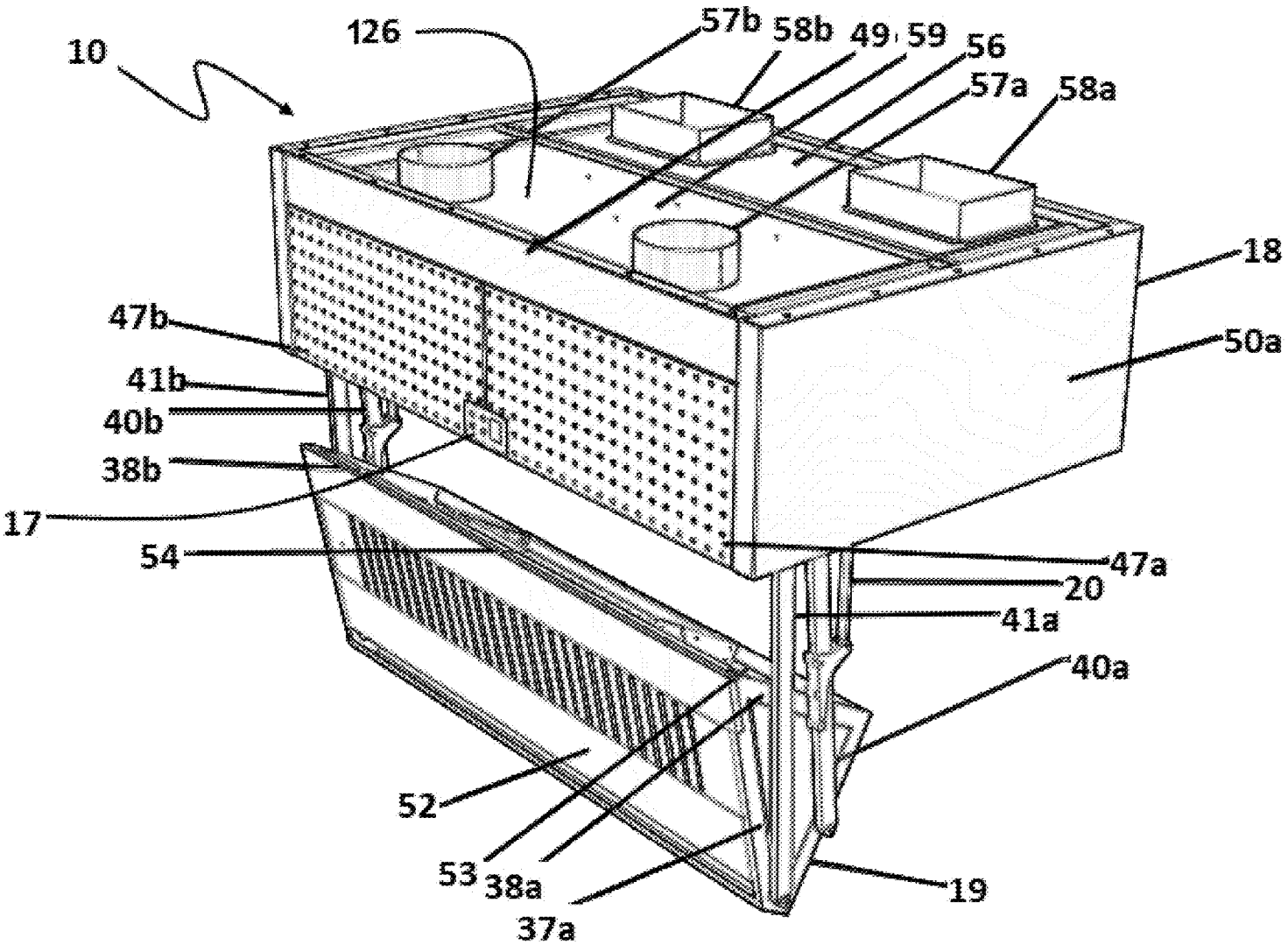
FIG. 8 is an above front isometric view of the first example exhaust canopy in the cleaning configuration with a top panel of an exhaust plenum removed.

Referring now to FIG. 8, there is shown the exhaust canopy 10 from in front and above in its cleaning configuration with the exhaust portion 19 fully lowered outside of the confines of the fixed portion 18. Visible in this view front and rear top panels, 59 and 56 respectively, of the fixed portion 19 of the canopy. The front top panel spans between top edges of the front top bracket 49 and side panels 50*a*/50*b*, while the rear top panel 56 lies adjacent and behind the front top panel 59, spanning between top edges of the side panels 50*a*/50*b* and rear panel 51. Projecting up from the front top panel 59 are left and right circular supply air collars, 57*a* and 57*b* respectively, of supply plenum 126. Projecting from the rear top panel 56 are left and right exhaust collars, 58*a* and 58*b* respectively.

Figure 9:
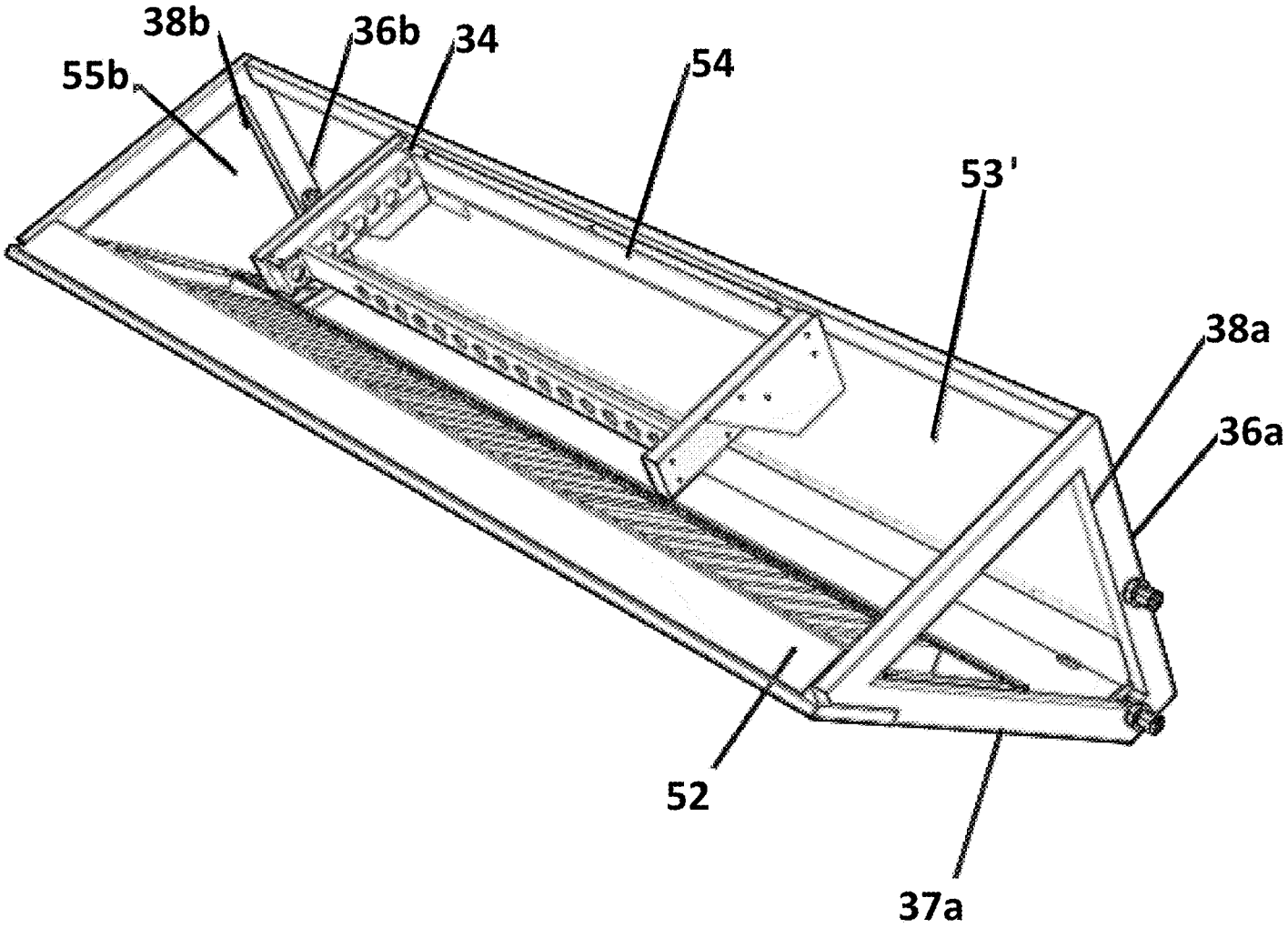
FIG. 9 is an above isometric view of the exhaust portion of the first example exhaust canopy with a left exhaust side panel and roof panel removed.

In FIGS. 8 and 9 it can be seen that the exhaust portion 19 is in the shape of an inverted triangular prism, having front and rear exhaust panels, 52 and 53 respectively, as well as a top/inverted base panel (not shown). Mounted on the inner surface of the rear exhaust panel 53 is an ultra violet light cassette 54 for removal of grease and odour.

Although removed in FIG. 8, triangularly shaped left and right exhaust side panels, 55*a* (FIG. 10) and 55*b* (FIG. 9) respectively, span the area between respective first, second and third rods, 36*a*/37*a*/38*a* and 36*b*/37*b*/38*b* of the exhaust frame.

Figure 10:
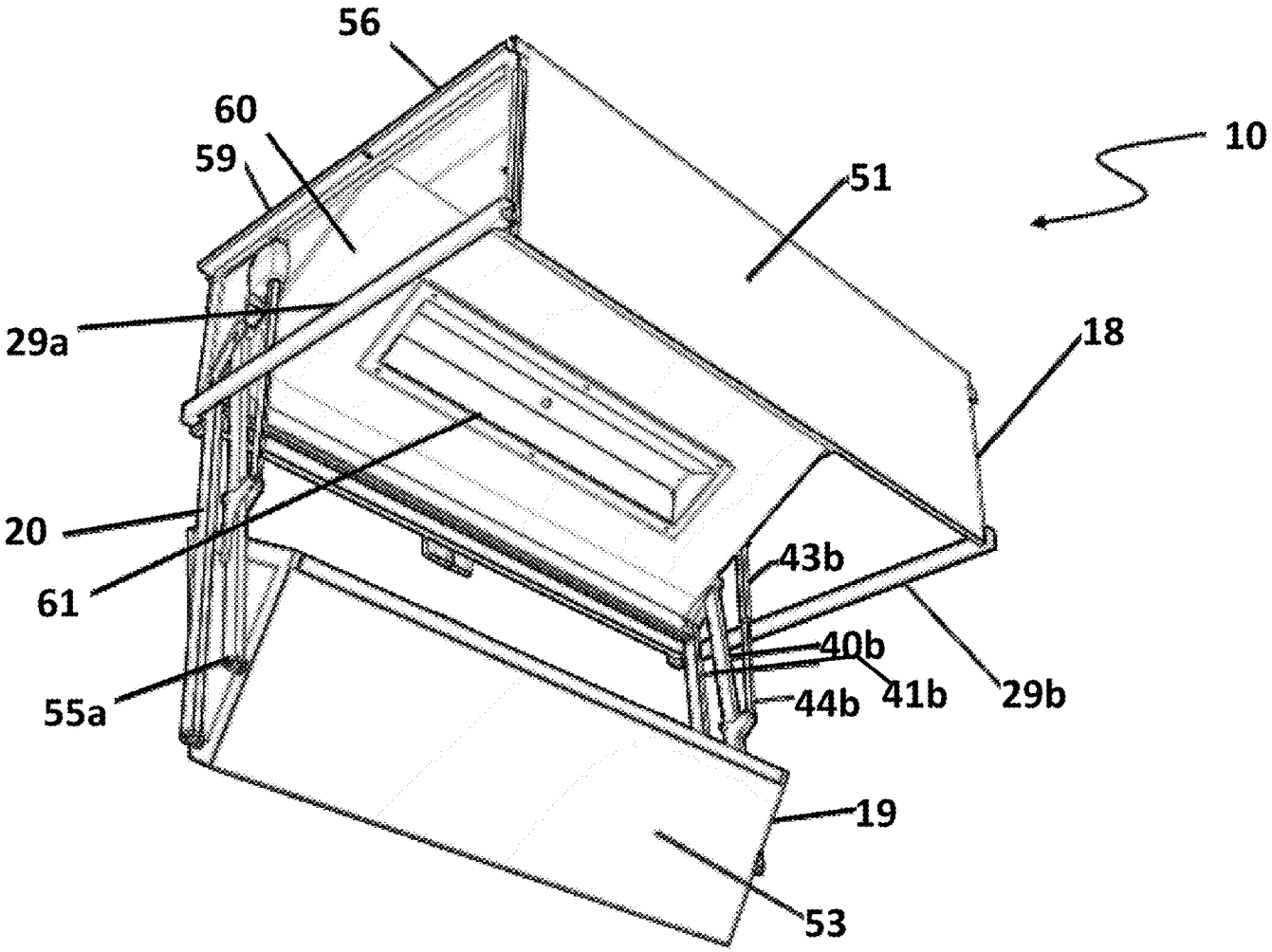
FIG. 10 is an isometric view from behind and beneath of the first example exhaust canopy in the cleaning configuration with both side panels removed.

Referring now to FIG. 10, there is shown the exhaust canopy 10 from behind and beneath, in an open or cleaning configuration, with the side panels 50*a*/50*b* removed for internal visibility. In this view, a light panel is seen sloping down and forward from around the junction of the front and rear top panels, 59 and 56 respectively. Centrally placed in the light panel 60 is a light housing 61 for an elongated source of light (not shown).

Figure 11:
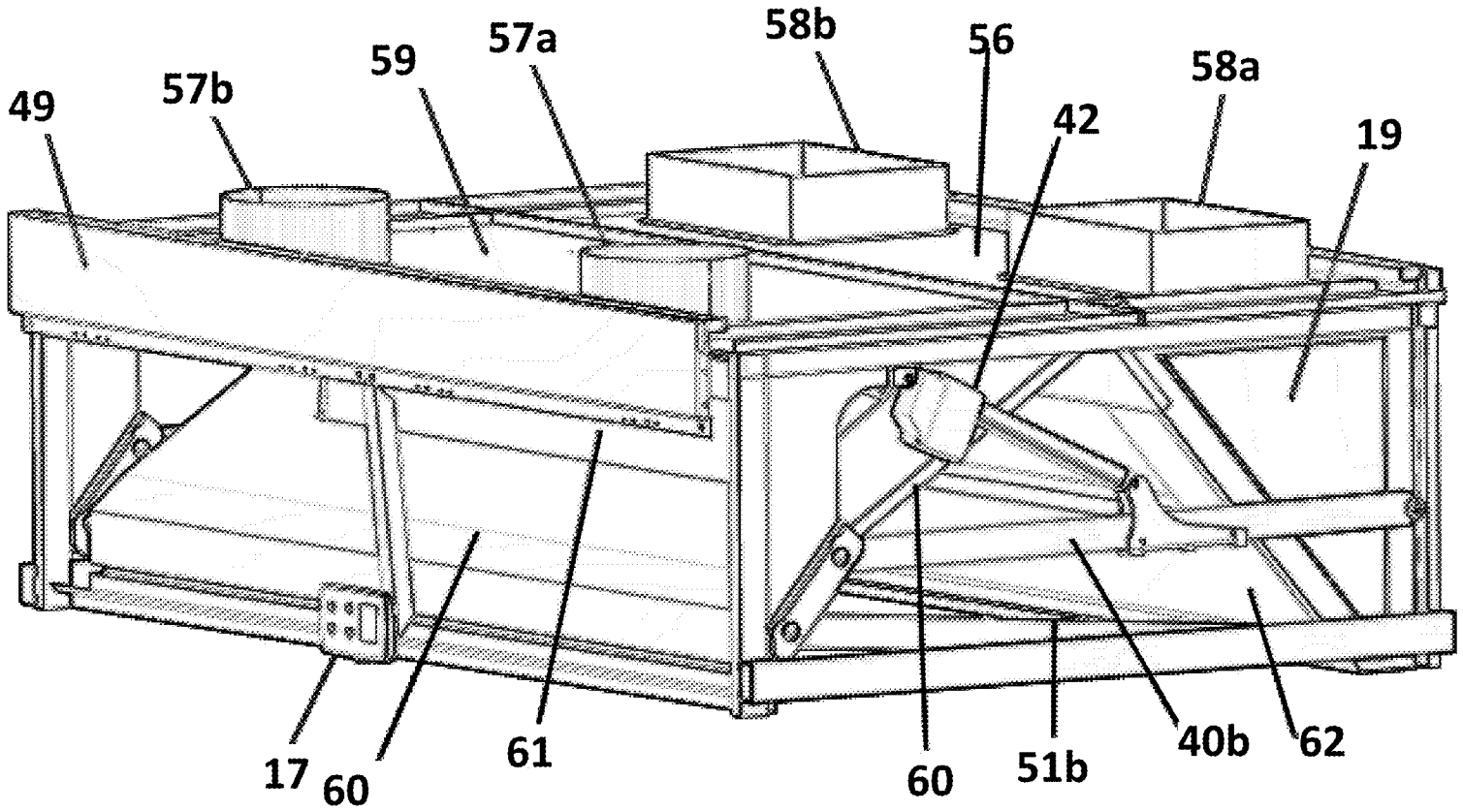
FIG. 11 is an isometric view of the first example exhaust canopy with side and front panels removed.

Referring now to FIG. 11, there is shown the exhaust canopy 10 in a closed or use configuration, with side panels 50*a*/50*b* and front panels 49*a*/49*b* removed for internal visibility. Shown in this view is a rear angled panel 62, sloping down and backward from the top edge of, and forming an apex with, the light panel 60.

Figure 12:
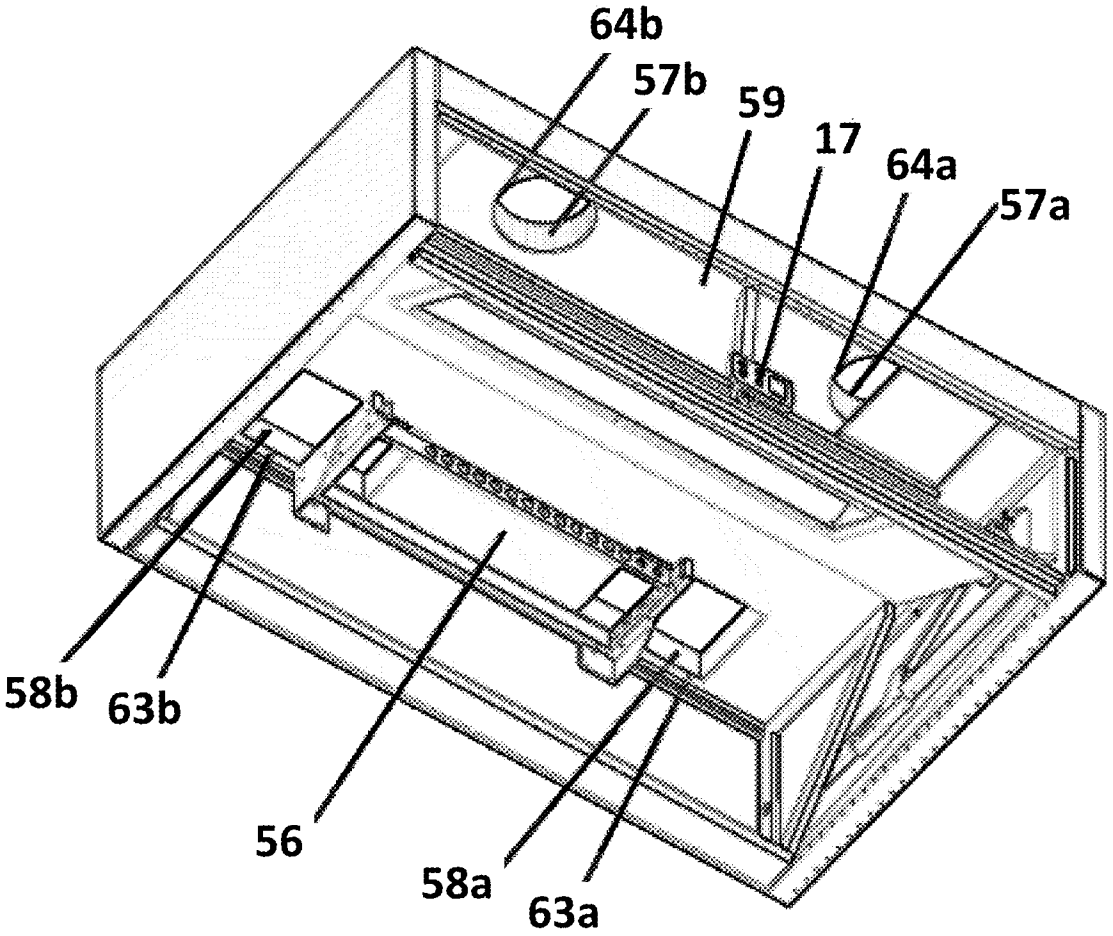
FIG. 12 is an isometric view of the first example exhaust canopy from beneath with front, lighting and exhaust plenum panels removed.

Referring now to FIG. 12, there is shown the exhaust canopy 10 in a closed or use configuration from in front and beneath. In this view, the rear angled panel has been removed to show left and right rectangular exhaust apertures, 63*a* and 63*b* respectively, defined in the rear top panel 56. Each exhaust aperture 63*a*/63*b* communicates with the interior opening of its respective rectangular exhaust collar

58*a*/58*b*. Additionally, the front panels 47*a*/47*b* have been removed to show left and right circular supply apertures 64*a*/64*b* respectively, defined in the front top panel 59. Each supply aperture 64*a*/64*b* communicates with the interior opening of its respective tubular supply collar 57*a*/57*b*.

Modifications and variations such as would be apparent to the skilled addressee are considered to fall within the scope of the present invention. The present invention is not to be limited in scope by any of the specific embodiments described herein. These embodiments are intended for the purpose of exemplification only. Functionally equivalent products, formulations and methods are clearly within the scope of the invention as described herein.

Reference to positional descriptions, such as lower and upper, are to be taken in context of the embodiments depicted in the figures, and are not to be taken as limiting the invention to the literal interpretation of the term but rather as would be understood by the skilled addressee.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprise", "comprises", "comprising", "including", and "having", or variations thereof are inclusive and therefore specify the presence of stated features, integers, steps, operations, elements, and/or components, but do not preclude the presence or addition of one or more other features, integers, steps, operations, elements, components, and/or groups thereof.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first", "second", and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner", "outer", "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Thus, while there has been described above what are believed to be the preferred arrangements of the invention, those skilled in the art will recognize that other and further modifications may be made thereto without departing from the spirit of the invention, and it is intended to claim all such changes and modifications as fall within the scope of the invention. Functionality may be added or deleted from the diagrams and operations may be interchanged among functional features. Steps may be added or deleted to methods described within the scope of the present invention.

Although the invention has been described with reference to specific examples, it will be appreciated by those skilled in the art that the invention may be embodied in many other forms.

It will be appreciated that the methods & apparatus described/illustrated above at least substantially provide an exhaust canopy suitable for mounting above domestic or commercial cooking equipment.

The methods & apparatus described herein, and/or shown in the drawings, are presented by way of example only and are not limiting as to the scope of the invention. Unless otherwise specifically stated, individual aspects and components of the methods & apparatus may be modified, or may have been substituted therefore known equivalents, or as yet unknown substitutes such as may be developed in the future or such as may be found to be acceptable substitutes in the future. The methods & apparatus may also be modified for a variety of applications while remaining within the scope and spirit of the claimed invention, since the range of potential applications is great, and since it is intended that the present methods & apparatus be adaptable to many such variations.

Also, future patent applications maybe filed in Australia or overseas on the basis of, or claiming priority from, the present application. It is to be understood that the following provisional claims are provided by way of example only, and are not intended to limit the scope of what may be claimed in any such future application. Features may be added to or omitted from the provisional claims at a later date so as to further define or re-define the invention or inventions.

The invention claimed is:

1. An exhaust canopy suitable for mounting above a cooker, stove-top, or cooking equipment, the exhaust canopy comprising:

a supply plenum comprising one or more apertures or conduits for passage of supply air, the supply plenum being adapted for fixed mounting on a wall;

an exhaust plenum connected by interconnecting arms to the supply plenum, the exhaust plenum comprising one or more apertures or conduits for passage of exhaust, the exhaust plenum comprising one or more removable replaceable exhaust filters;

an adjustment mechanism for moving the exhaust plenum with respect to the supply plenum, the adjustment mechanism comprising the interconnecting arms and an electric linear actuator connected with one or more of the interconnecting arms, the actuator being adapted to cause movement of the one or more of the interconnecting arms, thereby causing movement of the exhaust plenum with respect to the supply plenum;

a control unit mounted on the supply plenum, the control unit allowing a user to control the movement of the exhaust plenum automatically via the adjustment mechanism;

wherein the exhaust canopy is adjustable between a cleaning configuration in which the exhaust plenum is lowered towards the cooker, stove-top or cooking equipment to facilitate user access to the removable replaceable exhaust filters, and a use configuration in which the exhaust plenum is raised towards the supply plenum, in readiness for use when cooking on the cooker, stove-top or cooking equipment.

2. The exhaust canopy as claimed in claim 1 wherein the supply plenum comprises a stationary frame adapted for fixed mounting on a stationary object.

3. The exhaust canopy as claimed in claim 2 wherein the supply plenum further comprises panelling mounted on the stationary frame.

4. The exhaust canopy as claimed in claim 3 wherein the stationary object, on which the supply plenum is adapted for mounting, comprises a wall and/or ceiling.

5. The exhaust canopy as claimed in claim 1 wherein the of the interconnecting arms comprise upper and lower arms.

* * * * *